US005856626A

United States Patent [19]

Fischer et al.

[11] Patent Number: 5,856,626

[45] Date of Patent: Jan. 5, 1999

[54] CEMENTED CARBIDE BODY WITH INCREASED WEAR RESISTANCE

[75] Inventors: Udo Fischer, Vällingby; Mats Waldenström, Bromma; Torbjörn Hartzell, Stockholm, all of Sweden

[73] Assignee: Sandvik AB, Sandviken, Sweden

[21] Appl. No.: 772,101

[22] Filed: Dec. 20, 1996

[30] Foreign Application Priority Data

Dec. 22, 1995 [SE] Sweden ..... 9504623

[51] Int. Cl.[6] ..... C22C 29/02

[52] U.S. Cl. ..... 75/240; 75/242; 51/307; 428/689

[58] Field of Search ..... 75/240, 242; 419/26, 419/29, 35, 18; 51/307; 428/689

[56] References Cited

U.S. PATENT DOCUMENTS

| | | | |
|---|---|---|---|
| 4,708,037 | 11/1987 | Buljan et al. | 82/1 C |
| 4,743,515 | 5/1988 | Fischer et al. | 428/698 |
| 5,286,549 | 2/1994 | Hartzell et al. | 428/212 |
| 5,413,869 | 5/1995 | Hartzell et al. | 428/469 |
| 5,418,049 | 5/1995 | Drougge | 428/215 |
| 5,453,241 | 9/1995 | Akerman et al. | 419/14 |
| 5,481,049 | 1/1996 | Sato et al. | 568/909.5 |
| 5,505,902 | 4/1996 | Fischer et al. | 419/10 |
| 5,529,804 | 6/1996 | Bonneau et al. | 427/217 |
| 5,603,569 | 2/1997 | Salomon et al. | 366/347 |

*Primary Examiner*—Ngoclan Mai

*Attorney, Agent, or Firm*—Burns, Doane, Swecker & Mathis, L.L.P.

[57] ABSTRACT

There is now provided a cemented carbide button for rock drilling comprising a core and a surface zone surrounding the core whereby both the surface zone and the core contains WC ($\alpha$-phase) and a binder phase based on at least one of cobalt, nickel or iron and that the core in addition contains $\eta$-phase. In addition, in the inner part of the surface zone situated close to the core, the cobalt content is higher than the nominal content of cobalt and the cobalt content in the outermost part of the surface zone is lower than the nominal and increases in the direction towards the core, up to a maximum usually at the $\eta$-phase core. The grain size distribution of the hard constituent in the zone with high cobalt content and in the $\eta$-phase core is narrow in contrast to a button of the prior art in which the grain size distribution of the hard constituent in the zone with high cobalt content and the $\eta$-phase core is wide. As a result, a button with improved resistance against plastic deformation is obtained. The improvement is obtained by pressing and sintering a powder mixture which has not been milled in the conventional way, but in which the binder phase has been uniformly distributed by coating the hard constituent particles with binder phase.

2 Claims, 2 Drawing Sheets

CEMENTED CARBIDE BODY WITH INCREASED WEAR RESISTANCE

BACKGROUND OF THE INVENTION

The present invention relates to cemented carbide bodies useful in tools for rock drilling, mineral cutting, oil drilling and in tools for concrete and asphalt milling.

In U.S. Pat. No. 4,743,515, cemented carbide buttons are disclosed having a core with finely and evenly distributed η-phase embedded in the normal α+β-phase structure, and a surrounding surface zone with only α+β-phase (α=tungsten carbide, β=binder phase, e.g., cobalt, and η=$M_6C$, $M_{12}C$ and other carbides, e.g., $Co_3W_3C$). An additional condition is that in the inner part of the surface zone situated close to the core, the cobalt content is higher than the nominal content of cobalt and that the cobalt content in the outermost part of the surface zone is lower than the nominal and increases in the direction towards the core up to a maximum, usually at the η-phase core.

U.S. Pat. No. 5,286,549 discloses an improvement of the above-mentioned U.S. patent in which the cobalt content is essentially constant in the outer surface zone resulting in further increased wear properties.

According to U.S. Pat. No. 5,413,869, it has been found that further improvement is obtained in certain rock drilling applications if the core containing η-phase is exposed on the top surface.

Cemented carbide bodies according to the above-mentioned patents are manufactured according to powder metallurgical methods: milling, pressing and sintering. The milling operation is an intensive mechanical milling in mills of different sizes and with the aid of milling bodies. The milling time is on the order of several hours up to days. Such processing is believed to be necessary in order to obtain a uniform distribution of the binder phase in the milled mixture, but it results in a wide WC grain size distribution.

In U.S Pat. Nos. 5,505,902 and 5,529,804, methods of making cemented carbide are disclosed according to which the milling is essentially excluded. In order to obtain a uniform distribution of the binder phase in the powder mixture, the hard constituent grains are instead precoated with the binder phase, the mixture is further mixed with a pressing agent, pressed and sintered. In the first mentioned patent, the coating is made by a SOL-GEL method and in the second, a polyol is used.

An important restriction of the above-mentioned prior art patents is the toughness properties of the cobalt rich zone. During the heat treatment process after sintering, the η-phase in that zone is transformed to WC—Co resulting in a structure with both fine and coarse WC grains. Fine WC grain size in a cobalt rich matrix gives low resistance against plastic deformation in all applications where high forces and high temperatures are present such as in rock and coal cutting and hot forming. In these types of applications, there is substantial risk for damage of the whole tool caused by plastic deformation.

Another disadvantage of the prior art structure is the presence of both fine and coarse WC grains in the cobalt rich zone and the η-phase core, leading to low resistance against crack propagation.

OBJECTS AND SUMMARY OF THE INVENTION

It is an object of this invention to avoid or alleviate the problems of the prior art.

It is further an object of this invention to provide cemented carbide bodies useful in tools for rock drilling, mineral cutting, oil drilling and in tools for concrete and asphalt milling.

In one aspect of the invention there is provided a cemented carbide body preferably for use in rock drilling and mineral cutting, comprising a cemented carbide core and a surface zone surrounding the core whereby both the surface zone and the core contain WC, in which up to 15% by weight of W can be replaced by one or more of Ti, Zr, Hf, V, Nb, Ta, Cr and Mo, and 3–25% by weight of binder phase based on cobalt, iron and/or nickel, the surface zone having an outer part with a binder phase content which is lower than the nominal and an inner part having a binder phase content which is higher than the nominal, the average binder phase content in said outer part is 0.2–0.8 of the nominal and the binder phase content in said inner part reaches a highest value of at least 1.2 of the nominal binder phase content, and the core additionally, contains 2–60% by volume of η-phase with a grain size of 0.5–10 μm, while the surface zone is free of η-phase, the width of the core being 10–95% of the cross-section of the body wherein at least about 90% of the WC grains in the cobalt rich zone and the η-phase core is between 0.4 and 2.5 times the mean WC grain size.

In another aspect of the invention there is provided a method of manufacturing a cemented carbide button for rock drilling using a powder mixture comprising WC—Co with a substoichiometric carbon content in which the WC grains have been precoated with Co, sintering said powder mixture to form an η-phase-containing body and thereafter partially carburizing said body to form a button having an η-phase-containing core surrounded by an η-phase free surface zone.

DETAILED DESCRIPTION OF THE PREFERRED EMBODIMENTS OF THE INVENTION

Figure 1:
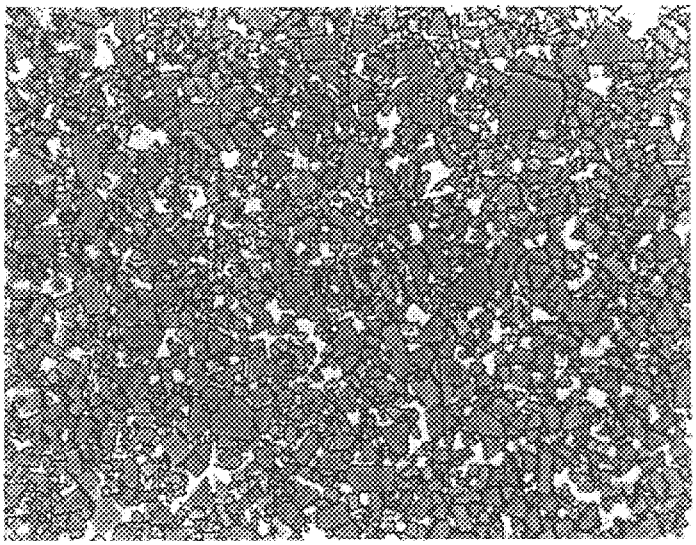
FIG. 1 shows in 1200× magnification, the microstructure of the cobalt rich zone according to the prior art.
Figure 2:
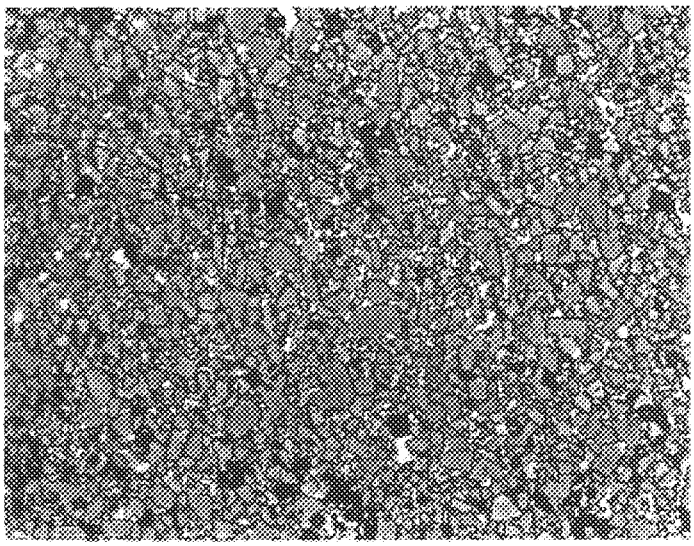
FIG. 2 shows in 1200× magnification, the microstructure of the η-phase core according to the prior art.
Figure 3:
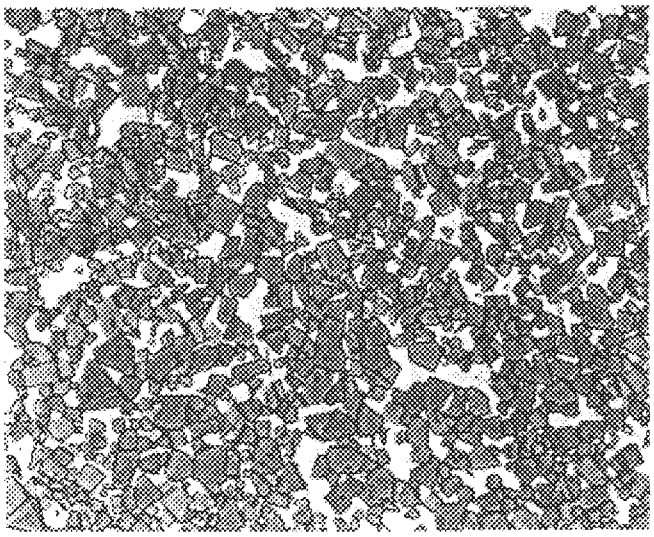
FIG. 3 shows in 1200× magnification, the microstructure of the cobalt rich zone according to the presently claimed invention.
Figure 4:
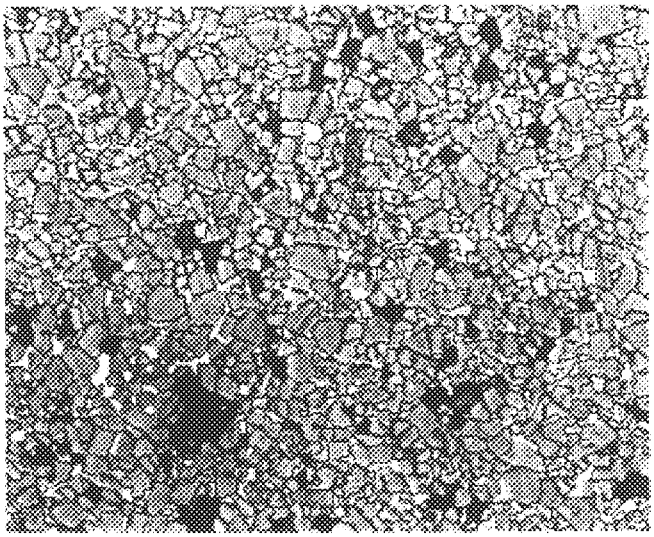
FIG. 4 shows in 1200× magnification, the microstructure of the η-phase core according to the presently claimed invention.

It has now surprising turned out that it is possible to control the manufacturing process in such a way that both fine and abnormally coarse WC grains can be avoided in both the cobalt rich zone and the η-phase-containing core.

According to the presently claimed invention, a powder is used which has not been milled mechanically in the conventional way. Surprisingly, it has been found that the formation of fine and abnormally coarse grains obtained when the η-phase is dissolved during sintering can be avoided in this way.

Rock bit buttons according to the presently claimed invention, have a core containing at least 2% by volume, preferably at least 5% by volume, of η-phase, but at the most 60% by volume, preferably at the most 35% by volume. The η-phase shall be fine-grained with a grain size of 0.5–10 μm, preferably 1–5 μm, and evenly distributed in the matrix of the normal WC—Co-structure. The width of the η-phase core shall be 10%–95%, preferably 25%–75%, of the cross-section of the cemented carbide body.

The binder phase content in the zone free of η-phase increases in the direction towards the η-phase core, up to a maximum usually at the η-phase core of at least 1.2 times, preferably at least 1.4 times, compared to the nominal value of the binder phase content in the η-phase core.

The WC grain size distribution is characterized in being relatively narrow. That is, at least about 90% of the WC grains are within 0.4–2.5 times the mean WC grain size. Preferably, the number of WC grains smaller than 0.4 times of the mean grain size is less than 5% in number and the number of grains larger than 2.5 times the mean grain size is less than 5% of the total number of grains.

The cobalt-portion in the η-phase can be completely or partly be replaced by at least one of iron or nickel, i.e., the η-phase itself can contain one or more of the iron group metals in combination.

Up to 15% by weight of tungsten in the α-phase can be replaced by one or more of the metallic carbide formers Ti, Zr, Hf, V, Nb, Ta, Cr and Mo.

According to the method of the presently claimed invention, a cemented carbide body is manufactured by powder metallurgical methods such as mixing, pressing and sintering in which a powder with substoichiometric content of carbon is sintered to an η-phase-containing body. The use of powders with substochiometric carbon content is known in the art, e.g., see U.S. Pat. No. 4,743,515. The powders are not milled as in conventional processes. Instead, by starting from a powder in which the WC grains are previously coated with binder phase, preferably using the above-mentioned SOL-GEL technique, the conventional milling can be replaced by mixing with a pressing agent and possibly additional WC- or Co-powder in order to obtain the desired composition. After sintering, the body is given a partially carburizing heat treatment whereby an η-phase-containing core surrounded by an η-phase free surface zone is obtained.

The invention is additionally illustrated in connection with the following Examples which are to be considered as illustrative of the present invention. It should be understood, however, that the invention is not limited to the specific details of the Examples.

EXAMPLE 1

In a coal mine in South Africa, a test with point attack cutting tools was run as follows:

Seam: Grit coal, top part of seam containing coarse-grained sandstone lenses; sandstone floor Machine: Voest Alpine AM Cutting speed: 2 m/s Penetration rate: 80 mm/revolution Cemented carbide grade:

Variant A: Buttons made from conventionally milled WC—Co-powder according to U.S. Pat. No. 4,743,515. WC grain size distribution in Co-rich zone was 15% less than 0.4 times mean grain size, 15% greater than 2.5 times mean grain size and a WC mean grain size of 3.5 μm.

Variant B: Buttons made in the same way but from WC—Co-powder which was produced from powder which was made by coating the WC grains with the cobalt by the SOL-GEL method, disclosed in U.S. Pat. No. 5,505,902. WC grain size distribution in Co-rich zone was 5% less than 0.4 times mean grain size, 5% greater than 2.5 times mean grain size and a WC mean grain size of 3.5 μm.

The cobalt content was 10 weight % in both Variants.

All buttons were sintered and heat treated in order to get the outer zone with low cobalt content, the cobalt rich zone and the η-phase-containing zone.

Results

Variant A: worn out after 3 shifts and 3.5 tons/tool

Variant B: worn out after 9 shifts and 11.3 tons/tool

The main reason for the poor performance of Variant A was plastic deformation of the cobalt rich zone due to the high temperature in the cutting edge because of high cutting forces when cutting in sandstone of the bottom of face.

EXAMPLE 2

Rock: Quartzite, heavily abrasive

Machine: Tamrock Super Drilling, Datamaxi

Drilling Data:

Impact pressure: 200 bar

Feeding pressure: 140 bar

Rotation: 130 rpm

Water pressure: 15 bar

Drill Bits: 45 mm button bits with five peripheral buttons ø=11 mm ballistic top Hole Depth: 5 m Variant 1: Cemented carbide according to the presently claimed invention with 6 weight % Co. WC grain size distribution in Co-rich zone was 4% less than 0.4 times mean grain size, 5% greater than 2.5 times mean grain size and a WC mean grain size of 2.5 μm.

Variant 2: Same as Variant 1, but made according to U.S. Pat. No. 4,743,515. WC grain size distribution in Co-rich zone was 20% less than 0.4 times mean grain size, 10% greater than 2.5 times mean grain size and a WC mean grain size of 2.5 μm.

Variant 3: Same as Variant 1, but with no η-phase core and even cobalt distribution.

In this rock there is obtained, in addition to heavy wear, also crack formation in the wear surface. The final damage of the bits is often button damage.

Result

| | Drilled length, m |
|---|---|
| Variant 1 | 415 |
| Variant 2 | 330 |
| Variant 3 | 290 |

Variant 3 obtained early damage due to crack formation in the wear surface.

Variant 2 also obtained cracks, but they were stopped partly in the cobalt rich zone.

Variant 1 obtained less cracks in the wear surface because of the narrow grain size distribution in which the finest WC grain size fraction is lacking. The cracks stopped in the cobalt rich zone.

EXAMPLE 3

Production drilling in iron ore, magnetite.

Rock: Magnetite, forming snake skin

Machine: Tamrock SOLO 1000 with HL1500 hammer

Button Bits: ø=115 mm

Hole Depth: 15–30 m upwards, one ring about 350–400 m

Drilling Data:

Impact pressure: 170 bar

Feeding pressure: 120 bar

Water pressure: 6 bar

Rotation: about 70 rpm

Variant 1: WC 5 μm and 6 weight % Co according to the presently claimed invention. WC grain size distribution in Co-rich zone was 2% less than 0.4 times mean grain size, 5% greater than 2.5 times mean grain size and a WC mean grain size of 5 μm.

Variant 2: Same as Variant 1, but made according to U.S. Pat. No. 4,743,515. WC grain size distribution in Co-rich zone was 20% less than 0.4 times mean grain size, 10% greater than 2.5 times mean grain size and a WC mean grain size of 5 μm.

Variant 3: Same as Variant 1, but with no η-phase core and even cobalt distribution.

Drilling without grinding of the buttons.

Result

Variant 1: One ring, 350 m, could be drilled. No button damages. Snake skin on the wear surface which, however, did not cause button damage. The bits could be reground an used to drill another ring of holes.

Variant 2: Snake skin formation causing button damage. The bit could not be used after 200 m.

Variant 3: Same as Variant 2, with a life of 195 m.

EXAMPLE 4

Test in a copper mine.

Rock: Biotite gneiss, mica schist

Machine: Bucyrus Erie with feed force 400 kN

Drill Bits: Roller bits ø=311 mm CS1 with test buttons in Row 1 in all cones

Variant 1: Bit with buttons according to the presently claimed invention. Cemented carbide with 6 weight % nominal cobalt content. WC grain size distribution in Co-rich zone was 3% less than 0.4 times mean grain size, 5% greater than 2.5 times mean grain size and a WC mean grain size of 5 μm.

Variant 2: Bit with buttons with composition and grain size the same as Variant 1, but made according to U.S. Pat. No. 4,743,515. WC grain size distribution in Co-rich zone was 20% less than 0.4 times mean grain size, 10% greater than 2.5 times mean grain size and a WC mean grain size of 5 μm.

Variant 3: Bit with buttons with no η-phase core and even cobalt distribution and 9.5 weight % Co.

| | Result |
|---|---|
| | Drilled length, m |
| Variant 1 | 2314 |
| Variant 2 | 1410 |
| Variant 3 | 1708 |

Variant 1 had worn out buttons and bearing failure as final damage.

Variant 2 had button damage on Row 1 as final damage.

Variant 3 had worn out buttons and low drilling rate as final life length determinlng factor.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A cemented carbide body preferably for use in rock drilling and mineral cutting, comprising a cemented carbide core and a surface zone surrounding the core whereby both the surface zone and the core contain WC, in which up to 15% by weight of W can be replaced by one or more of Ti, Zr, Hf, V, Nb, Ta, Cr and Mo, and 3–25% by weight of binder phase based on cobalt, iron and/or nickel, the surface zone having an outer part with a binder phase content which is lower than the nominal and an inner part having a binder phase content which is higher than the nominal, the average binder phase content in said outer part is 0.2–0.8 of the nominal and the binder phase content in said inner part reaches a highest value of at least 1.2 of the nominal binder phase content, and the core additionally, contains 2–60% by volume of η-phase with a grain size of 0.5–10 μm, while the surface zone is free of η-phase, the width of the core being 10–95% of the cross-section of the body wherein at least about 90% of the WC grains in the cobalt rich zone and the η-phase core is between 0.4 and 2.5 times the mean WC grain size.

2. The cemented carbide button of claim 1 wherein the WC grain size distribution in the cobalt rich zone and the η-phase core has a maximum 5% of the total number of WC-grains smaller than 0.4 times the mean grain size and a maximum 5% of the total number of WC grains larger than 2.5 times the mean grain size.

* * * * *